US009827762B2

(12) United States Patent
Atsuta

(10) Patent No.: US 9,827,762 B2
(45) Date of Patent: Nov. 28, 2017

(54) LIQUID EJECTION HEAD AND LIQUID EJECTION APPARATUS

(71) Applicant: CANON KABUSHIKI KAISHA, Tokyo (JP)

(72) Inventor: Tomohisa Atsuta, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/155,616

(22) Filed: May 16, 2016

(65) Prior Publication Data

US 2016/0347060 A1 Dec. 1, 2016

(30) Foreign Application Priority Data

May 28, 2015 (JP) ..... 2015-108917

(51) Int. Cl.
*B41J 2/14* (2006.01)

(52) U.S. Cl.
CPC ..... *B41J 2/14* (2013.01); *B41J 2002/14491* (2013.01)

(58) Field of Classification Search
CPC .... B41J 2/1623; B41J 2/1639; B41J 2/14072; B41J 2/14024; B41J 2/14427; B41J 2/1648; B41J 2002/14491; B41J 2002/14362; B41J 2/1433; B41J 2/14129; B41J 2/1404; B41J 2/162; B41J 2/16; B41J 2/14
USPC ..... 347/20, 44, 47, 50, 54, 58, 65, 71
See application file for complete search history.

(56) References Cited

U.S. PATENT DOCUMENTS 7,771,020 B2 8/2010 Miyazaki et al.
8,220,905 B2 * 7/2012 Sugahara ..... B41J 2/14233 347/50
2015/0109369 A1 * 4/2015 Nagata ..... B41J 2/14072 347/54

FOREIGN PATENT DOCUMENTS

JP 2008-023962 A 2/2008

* cited by examiner

*Primary Examiner* — Jannelle M Lebron
(74) *Attorney, Agent, or Firm* — Fitzpatrick, Cella, Harper & Scinto

(57) ABSTRACT

A liquid ejection head and a liquid ejection apparatus are configured to suppress degradation in the insulation property of an electrical wiring substrate while preventing an ejection element substrate from being cracked or a wiper from being abraded. As one configuration, a step portion with a step surface having a step between an ejection opening surface and a surface for mounting an electrical wiring substrate thereon in a second support member is provided and a gap between the ejection element substrate and the step portion and a region between the electrical wiring substrate and a stepped surface are sealed by a sealant.

11 Claims, 11 Drawing Sheets

LIQUID EJECTION HEAD AND LIQUID EJECTION APPARATUS

BACKGROUND OF THE INVENTION

Field of the Invention

The present invention relates to a liquid ejection head used in a liquid ejection apparatus and a liquid ejection apparatus.

Description of the Related Art

A liquid ejection apparatus includes a liquid ejection head that ejects a liquid. The liquid ejection head includes an ejection element substrate that includes a plurality of ejection openings arranged to eject a liquid therefrom, a support member that supports and fixes the ejection element substrate, and an electrical wiring substrate that transmits an ejection signal to the ejection element substrate. The periphery of the ejection element substrate is sealed by a sealant. Since the periphery of the ejection element substrate is sealed, the corrosion of the electrical wiring substrate or the non-protected end surface of the ejection element substrate is suppressed.

Further, lead terminals connected to bumps provided on the ejection element substrate and the electrical wiring substrate are also sealed by a sealant. By the sealing operation, the corrosion of the lead terminals caused by the liquid is prevented.

In order to select a material having a high adhesion property with respect to a plurality of members as the sealant used in this way, a material having a large internal stress or linear expansion coefficient in a hardened state needs to be selected. Accordingly, there is a case in which the sealant having a large internal stress or linear expansion coefficient in a hardened state may damage the ejection element substrate due to the expansion/contraction state of the sealant, the hardened shrinkage of the sealant, and the swelling of the sealant caused by an ink in accordance with a change in temperature in a manufacturing process and a change in temperature in a product usage environment.

In some cases, the amount of the sealant is decreased in order to prevent the damage of the ejection element substrate. If the amount of the sealant is decreased, a wiper may be abraded by the edge of the ejection element substrate when a surface provided with the ejection opening of the liquid ejection head is cleaned by the wiper. As a result, the cleaning operation is not sufficiently performed at the abraded portion and hence the ejection operation is influenced.

Japanese Patent Laid-Open No. 2008-23962 discloses a configuration in which a block is provided in a space between an ejection element substrate and a second support member or the block is integrated with the second support member. Accordingly, the amount of the sealant is decreased and the expansion/contraction amount of the sealant is decreased. As a result, the wiper is not abraded while the damage of the ejection element substrate is prevented.

However, Japanese Patent Laid-Open No. 2008-23962 does not disclose a technique of sealing the second support member and the electrical wiring substrate. Further, it is difficult to apply a sealant by a needle even when the second support member and the electrical wiring substrate are sealed.

Therefore, a method of supplying a sealant to a sealing portion by a capillary phenomenon is considered. However, since the second support member and the electrical wiring substrate come into close contact with each other, the sealant hardly enters therebetween. Further, since the size of the gap is not taken into consideration, a sealant is not easily supplied to a boundary surface between both members by the capillary phenomenon. As a result, there is a concern that the sealing operation is not sufficiently performed and the insulation property of the electrical wiring substrate is degraded.

SUMMARY OF THE INVENTION

Thus, an object of the present invention is to provide a liquid ejection head and a liquid ejection apparatus suppressing degradation in insulation property of an electrical wiring substrate while suppressing an ejection element substrate from being cracked or a wiper from being abraded.

According to an aspect of the present invention, provided is a liquid ejection head including: an ejection element substrate that includes an ejection opening capable of ejecting a liquid; a support member that includes a substrate mounting surface for mounting an electrical wiring substrate thereon and mounts the ejection element substrate on a mounting surface different from the substrate mounting surface, in which a step portion formed along the ejection element substrate is provided on a surface of the support member, a step surface of the step portion is formed so that a vertical distance from the surface of the support member is shorter than those of the substrate mounting surface and the ejection opening surface provided with the ejection opening of the ejection element substrate, and a gap between the step portion and the ejection element substrate and a gap between a surface connecting the step surface to the substrate mounting surface and the electrical wiring substrate mounted on the support member are sealed by a sealant.

According to the invention, it is possible to provide a liquid ejection head and a liquid ejection apparatus capable of suppressing degradation in insulation property of an electrical wiring substrate while suppressing an ejection element substrate from being cracked or a wiper from being abraded.

Further features of the present invention will become apparent from the following description of exemplary embodiments (with reference to the attached drawings).

DESCRIPTION OF THE EMBODIMENTS

First Embodiment

Hereinafter, a first embodiment of the present invention will be described with reference to the drawings.

Figure 1A:
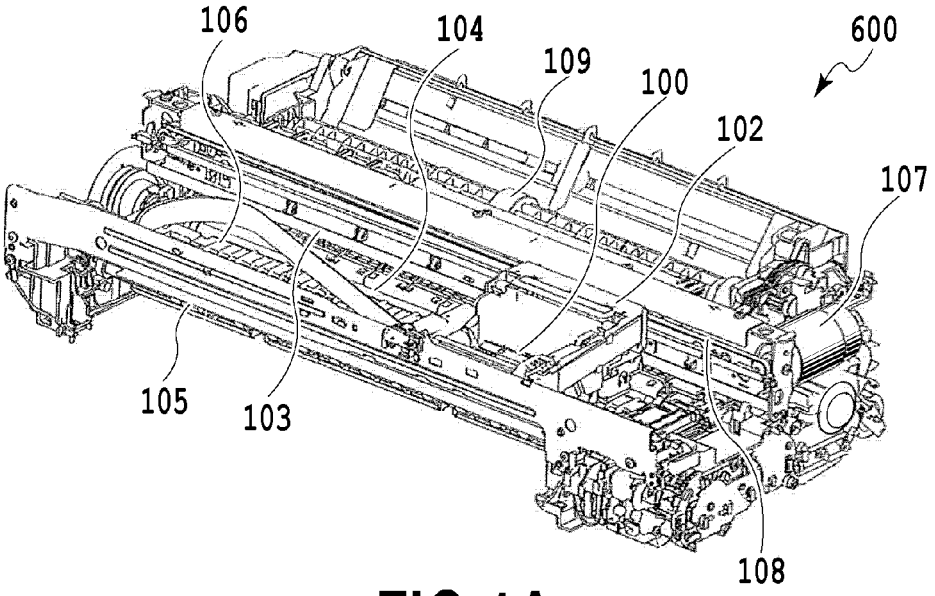
FIG. 1A is a perspective view illustrating a liquid ejection apparatus.
Figure 1B:
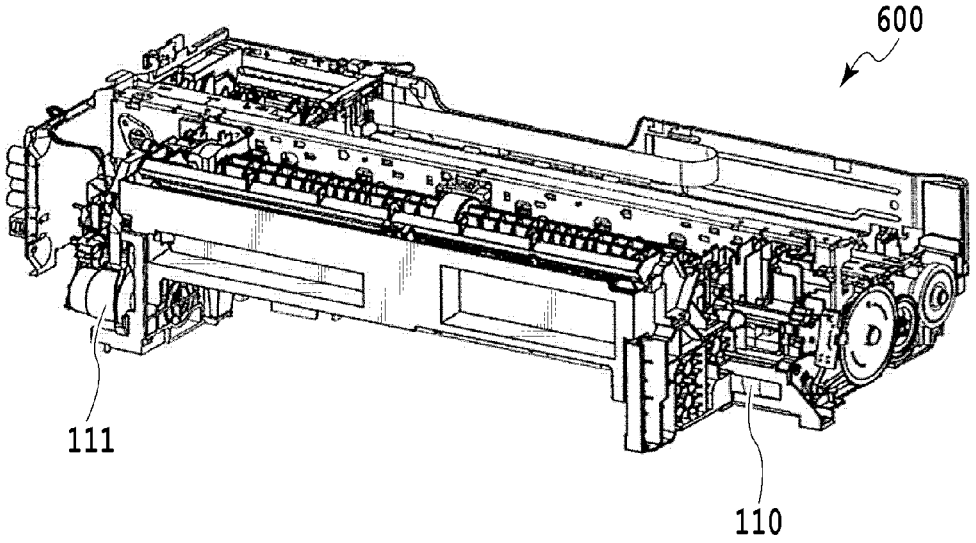
FIG. 1B is a perspective view illustrating the liquid ejection apparatus.

FIGS. 1A and 1B are perspective views illustrating a liquid ejection apparatus 600 according to the present embodiment. A carriage 102 equipped with a liquid ejection head 100 is supported so as to be movable in a reciprocating manner along a guide 103 extending in the main scan direction. The carriage 102 is driven by a carriage motor 107 through a belt 108.

A printing medium such as a sheet is fed by a sheet feeding roller 109 driven by a sheet feeding motor 111 of a sheet feeding mechanism through a gear set and is delivered onto a platen 106 by a conveying roller 104 and a pinching roller (not illustrated). A sheet discharging roller 105 is disposed at the downstream side of the platen 106 in the conveying direction and an auxiliary roller (not illustrated) comes into press-contact with the sheet discharging roller 105.

The conveying roller 104 and the sheet discharging roller 105 are driven by a conveying motor 110 through a belt and a gear set. A printing operation is performed in a manner such that a liquid is ejected from the ejection openings, which are capable of ejecting a liquid, of the liquid ejection head 100 onto the printing medium conveyed on the platen 106 by the conveying roller 104 and the sheet discharging roller 105.

When a printing operation is performed on the printing medium, the carriage 102 is accelerated from a stop state and moves at a constant speed through the scan range of the printing operation. At this time, a liquid is ejected from the ejection openings of the liquid ejection head 100 onto the printing medium so as to form an image thereon. After the printing operation corresponding to one line is performed while the carriage 102 scans the scan range one or plural times, the carriage 102 is decelerated and stopped. Subsequently, the printing medium is conveyed by a predetermined amount in accordance with the rotation of the conveying roller 104 and the sheet discharging roller 105.

Figure 2:
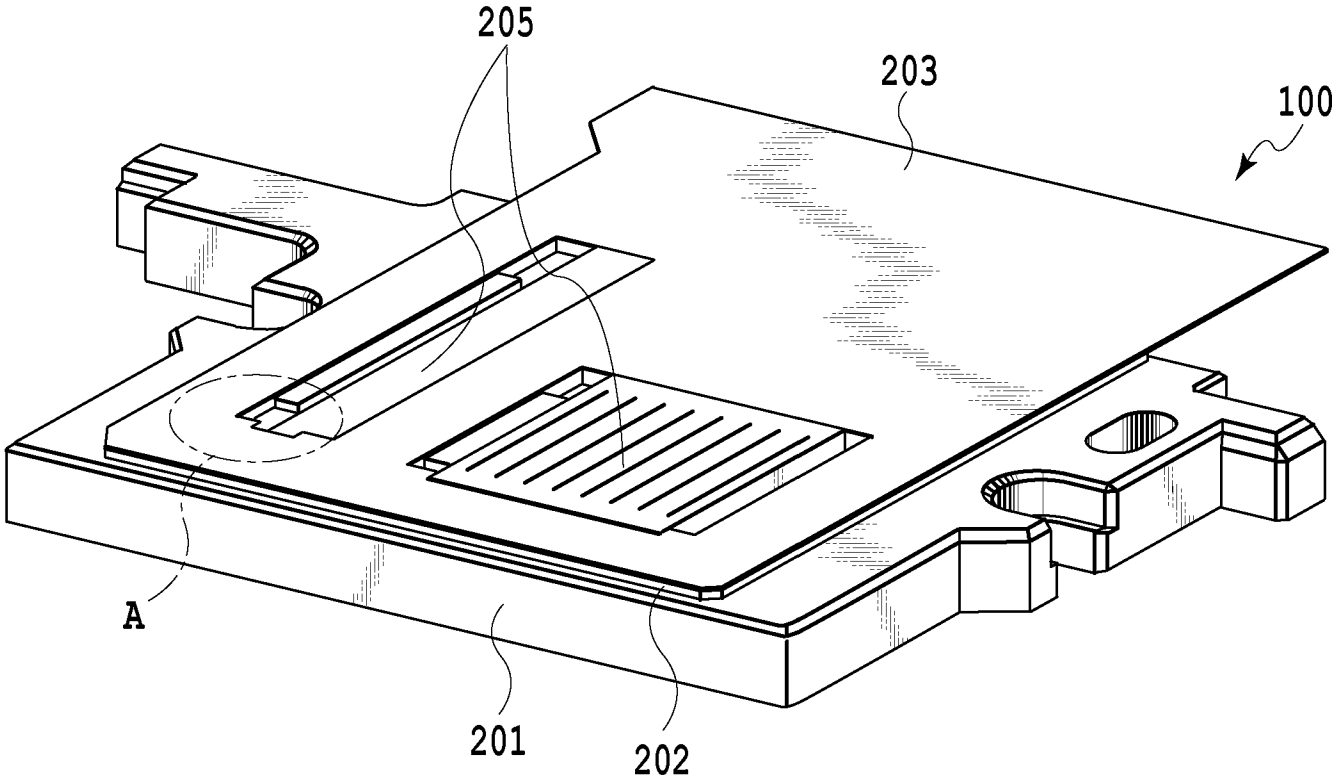
FIG. 2 is a perspective view illustrating a liquid ejection head mounted on a carriage.
Figure 3:
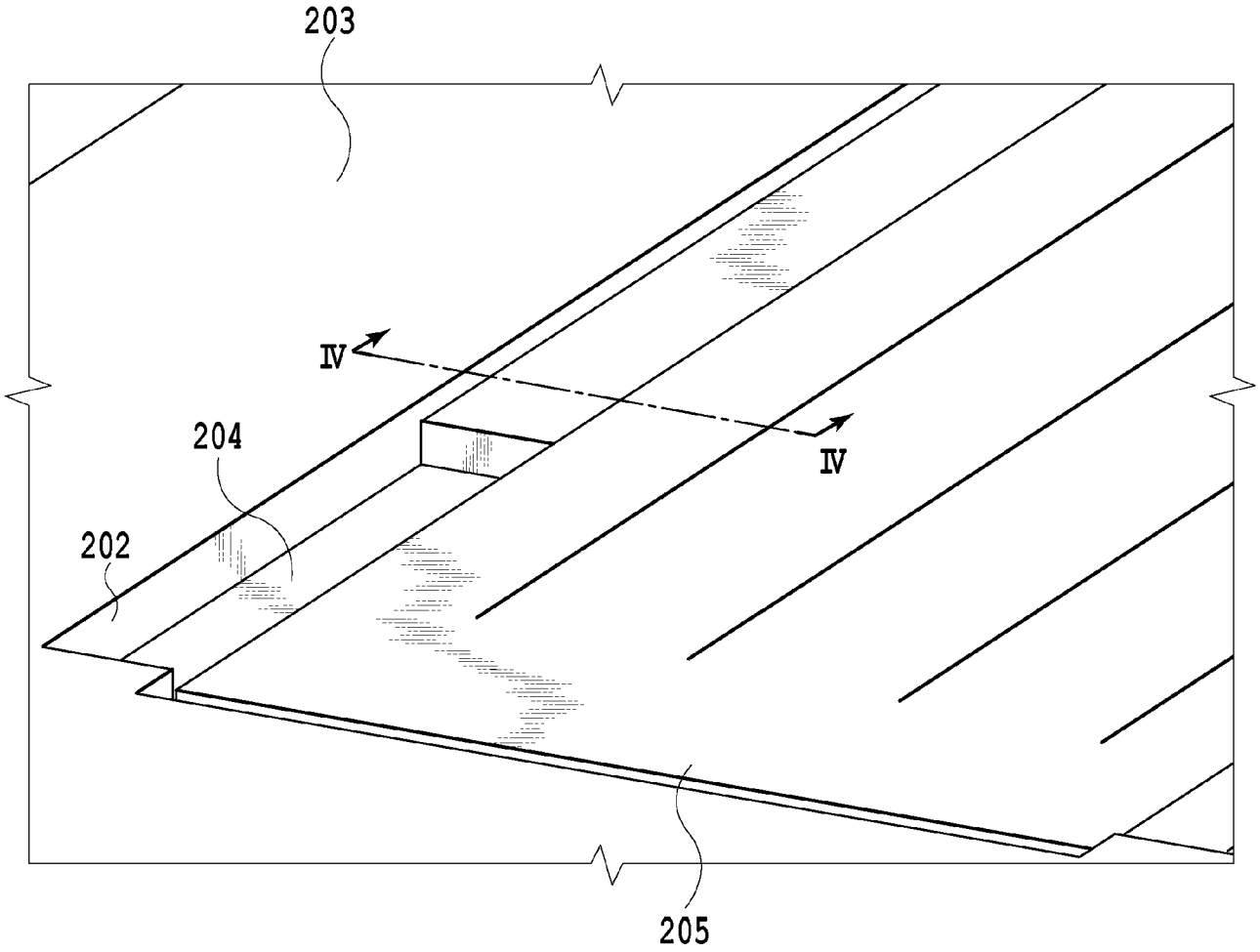
FIG. 3 is an enlarged view of a part A of FIG. 2.
Figure 4:
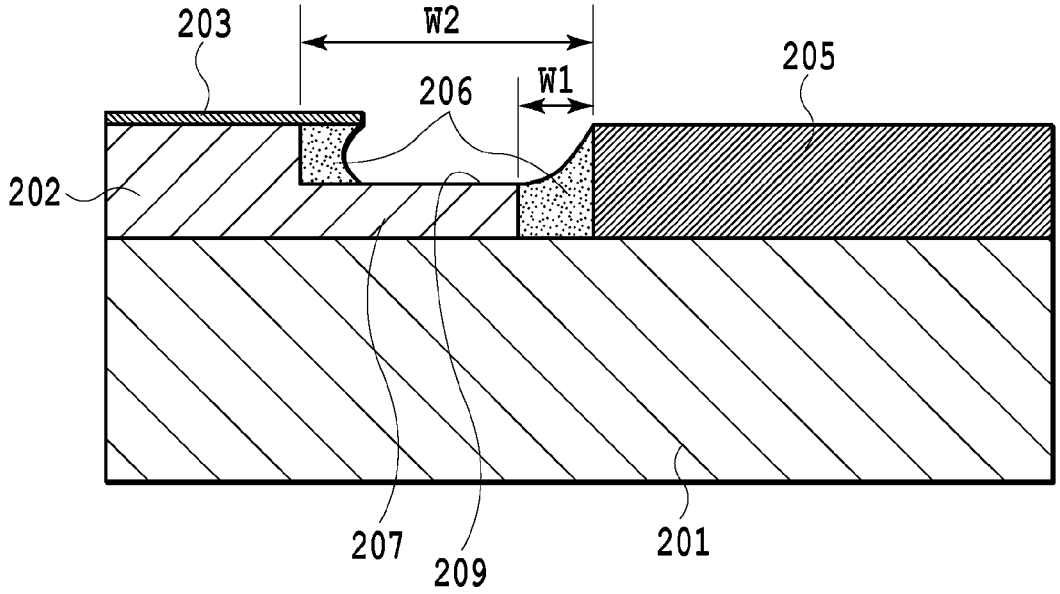
FIG. 4 is a cross-sectional view taken along the line IV-IV of FIG. 3.

FIG. 2 is a perspective view illustrating the liquid ejection head 100 mounted on the carriage 102, FIG. 3 is an enlarged view of a part A of FIG. 2, and FIG. 4 is a cross-sectional view taken along the line IV-IV of FIG. 3. The liquid ejection head 100 has a configuration in which a second support member 202 and an ejection element substrate 205 are mounted on a first support member 201 and an electrical wiring substrate 203 is mounted on the substrate mounting surface of the second support member 202. As illustrated in FIG. 4, a gap between the ejection element substrate 205 and the second support member 202 and a gap between the electrical wiring substrate 203 and the second support member 202 are sealed by a sealant 206.

Since the periphery of the ejection element substrate 205 or the electrical wiring substrate 203 is sealed by the sealant 206, it is possible to suppress corrosion caused when the non-protected end surface of the ejection element substrate 205 or the electrical wiring substrate 203 contacts the liquid. Further, the lead terminals connecting the bumps provided in the ejection element substrate 205 and the electrical wiring substrate 203 are also sealed by the sealant. By this sealing operation, it is possible to suppress corrosion caused when the lead terminals contact the liquid.

As illustrated in FIG. 3, a part of a gap between the second support member 202 and the ejection element substrate 205 is provided with a sealing supply portion 204 as a portion supplying the sealant 206. The second support member 202 is provided so as to surround the periphery of the ejection element substrate 205. At the manufacturing step, the sealant 206 is supplied to the sealing supply portion 204 through a needle. The sealant 206 supplied to the sealing supply portion 204 flows into a boundary portion between the ejection element substrate 205 and the second support member 202 and flows into a boundary portion between the electrical wiring substrate 203 and the second support member 202.

When the sealant 206 flowing into the boundary portions is hardened, the boundary portion between the ejection element substrate 205 and the second support member 202 and the boundary portion between the electrical wiring substrate 203 and the second support member 202 are sealed. Hereinafter, a sealing operation using the sealant 206 will be described in detail.

As illustrated in FIG. 4, a step is formed in a part of the second support member 202. A portion sealed with the ejection element substrate 205 is provided with a step portion 207 having a thin plate thickness (a thickness in the up and down direction of FIG. 4) in relation to the other portions other than the sealing supply portion 204. The step portion 207 is provided along the ejection element substrate 205 on the surface of the support member (herein, the surface of the first support member 201). A step surface 209 of the step portion 207 is formed at a height in which the step surface 209 does not protrude from the substrate mounting surface of the second support member 202 having the electrical wiring substrate 203 mounted thereon and the ejection opening surface provided with the ejection opening of the ejection element substrate 205.

That is, the step surface 209 is formed so that the vertical distance from the surface of the support member is shorter than those of the substrate mounting surface and the ejection opening surface. When the sealant 206 supplied to the sealing supply portion 204 is hardened while flowing between the ejection element substrate 205 and the step portion 207, the gap between the ejection element substrate 205 and the step portion 207 is sealed. In FIG. 4, the width W1 of the sealing area between the ejection element substrate 205 and the step portion 207 is about ¼ of the width W2 in a case where the sealing operation is performed without the step portion 207. Desirably, W1/W2 is equal to or larger than ⅕ and equal to or smaller than ⅓.

When a gap between the ejection element substrate 205 and the step portion 207 is sealed, the sealant 206 seals the end surface up to the upper surface of the ejection element substrate 205 along the end surface of the ejection element substrate 205 as illustrated in FIG. 4. Accordingly, it is possible to suppress the corrosion of the non-protected end surface of the ejection element substrate 205. As for the sealant 206 between the ejection element substrate 205 and the step portion 207, the amount of the sealant is smaller than the amount of the sealant used when the step portion 207 is not provided. At this time, the residual stress of the hardened sealant is small. Thus, the influence of the stress of the hardened sealant 206 with respect to the ejection element substrate 205 is small and hence the damage of the ejection element substrate 205 can be suppressed.

Figure 5:
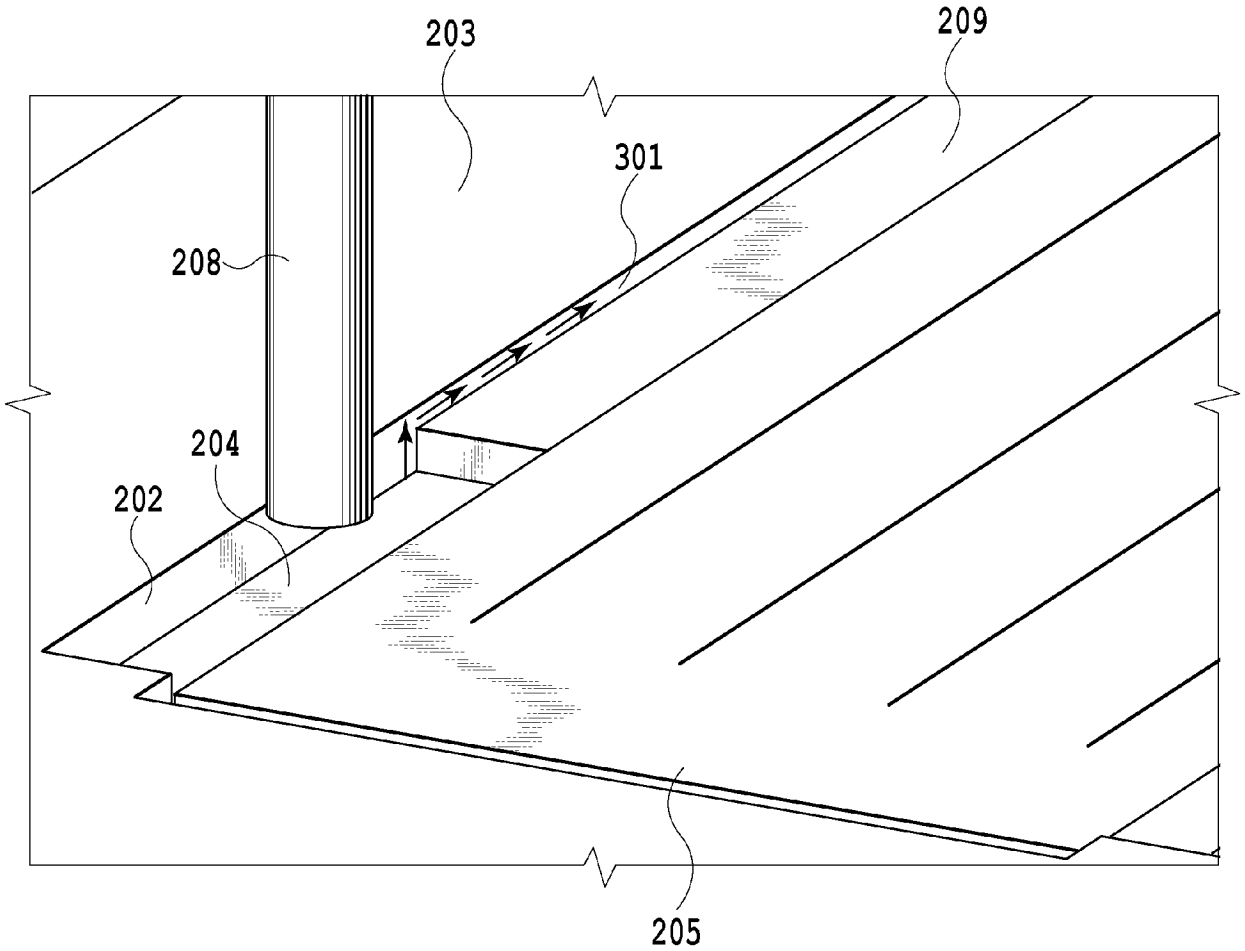
FIG. 5 is an enlarged view of a part A of FIG. 2.

FIG. 5 is an enlarged view of a part A of FIG. 2. As described above, the sealant 206 supplied to the sealing supply portion 204 by a needle 208 flows into a gap between the ejection element substrate 205 and the second support member 202. Here, the sealant 206 supplied to the sealing supply portion 204 flows on the boundary portion in a manner such that the sealant 206 forms a meniscus in the gap between the electrical wiring substrate 203 and the step portion 207 of the second support member 202 as indicated by the arrow of FIG. 5.

The sealant 206 supplied to the sealing supply portion 204 flows on a boundary portion between the stepped surface (a surface connecting the step surface 209 and the substrate mounting surface) 301 of the second support member 202 and the electrical wiring substrate 203 mounted on the second support member 202 by a capillary phenomenon so as to seal the boundary portion. The stepped surface 301 of the second support member 202 is a surface connecting the step surface 209 and the substrate mounting surface. That is, the sealant 206 also seals a gap between a surface connecting the step surface 209 to the substrate mounting surface and the electrical wiring substrate mounted on the support member. Furthermore, as illustrated in FIG. 4, the electrical wiring substrate 203 includes a portion mounted on the substrate mounting surface of the second support member 202 and a portion protruding from the substrate mounting surface toward the ejection element substrate 205. The sealant 206 seals a surface near the second support member 202 of a portion protruding toward the ejection element substrate 205 in the electrical wiring substrate 203. In FIG. 5, the step portion 207 has a thickness of about ½ of the thickness of the portion mounted with the electrical wiring substrate 203 in the second support member 202.

Desirably, the ratio is equal to or larger than ⅓ and equal to or smaller than ⅗. By the thickness of the step portion 207, an appropriate space into which the sealant 206 supplied to the sealing supply portion 204 flows by a capillary phenomenon is formed when a boundary portion between the electrical wiring substrate 203 and the stepped surface 301 of the second support member 202 is sealed. Furthermore, it is desirable to change the thickness of the step portion 207 for forming the space in accordance with the viscosity of the sealant to be used.

In the present embodiment, since the step portion 207 is provided, a sufficient space into which the sealant 206 flows is formed between the electrical wiring substrate 203 and the step portion 207 and hence the sealant 206 easily flows along the boundary portion between the electrical wiring substrate 203 and the second support member 202. When the sealant 206 flowing in this way is hardened, the boundary portion between the electrical wiring substrate 203 and the second support member 202 is sealed and hence the electrical wiring substrate 203 can be insulated and protected.

Further, since the second support member 202 is provided with the step portion 207, a wiper contacts the ejection opening surface and hardly contacts the second support member 202 when the ejection opening surface provided with the ejection opening of the ejection element substrate 205 is wiped and cleaned by the wiper. Accordingly, it is possible to suppress the abrasion of the wiper during the cleaning operation and to suppress the ejection opening from being blocked by cut chips of the wiper. Further, since the wiping performance is maintained, the cleaning operation can be performed in a satisfactory state.

Second Embodiment

Hereinafter, a second embodiment of the present invention will be described with reference to the drawings. Furthermore, since the basic configuration of the present embodiment is similar to that of the first embodiment, only a characteristic configuration will be described below.

Figure 6:
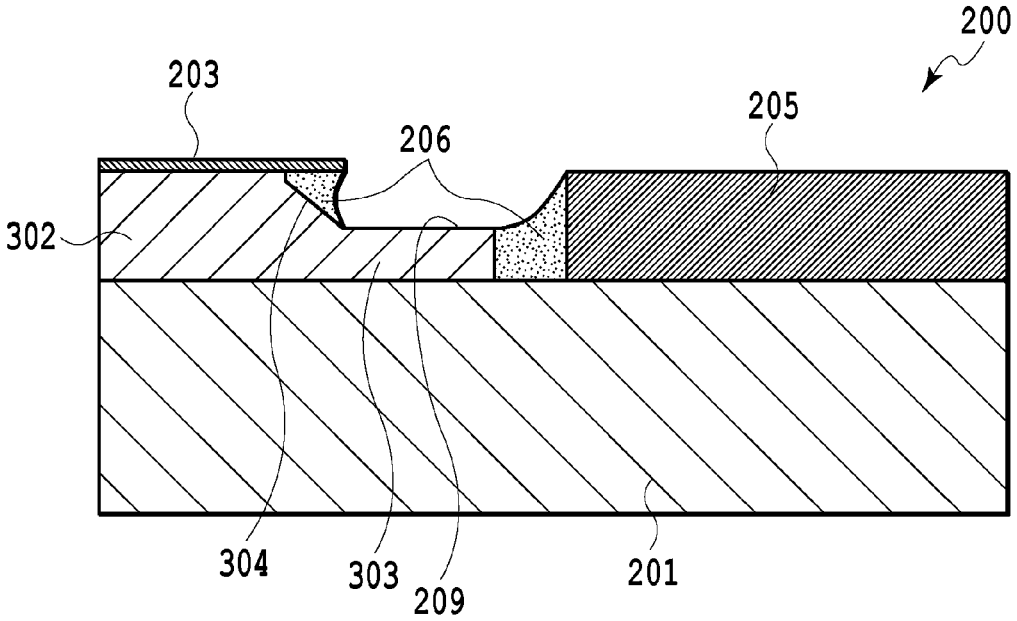
FIG. 6 is a cross-sectional view illustrating a part of the liquid ejection head.
Figure 7:
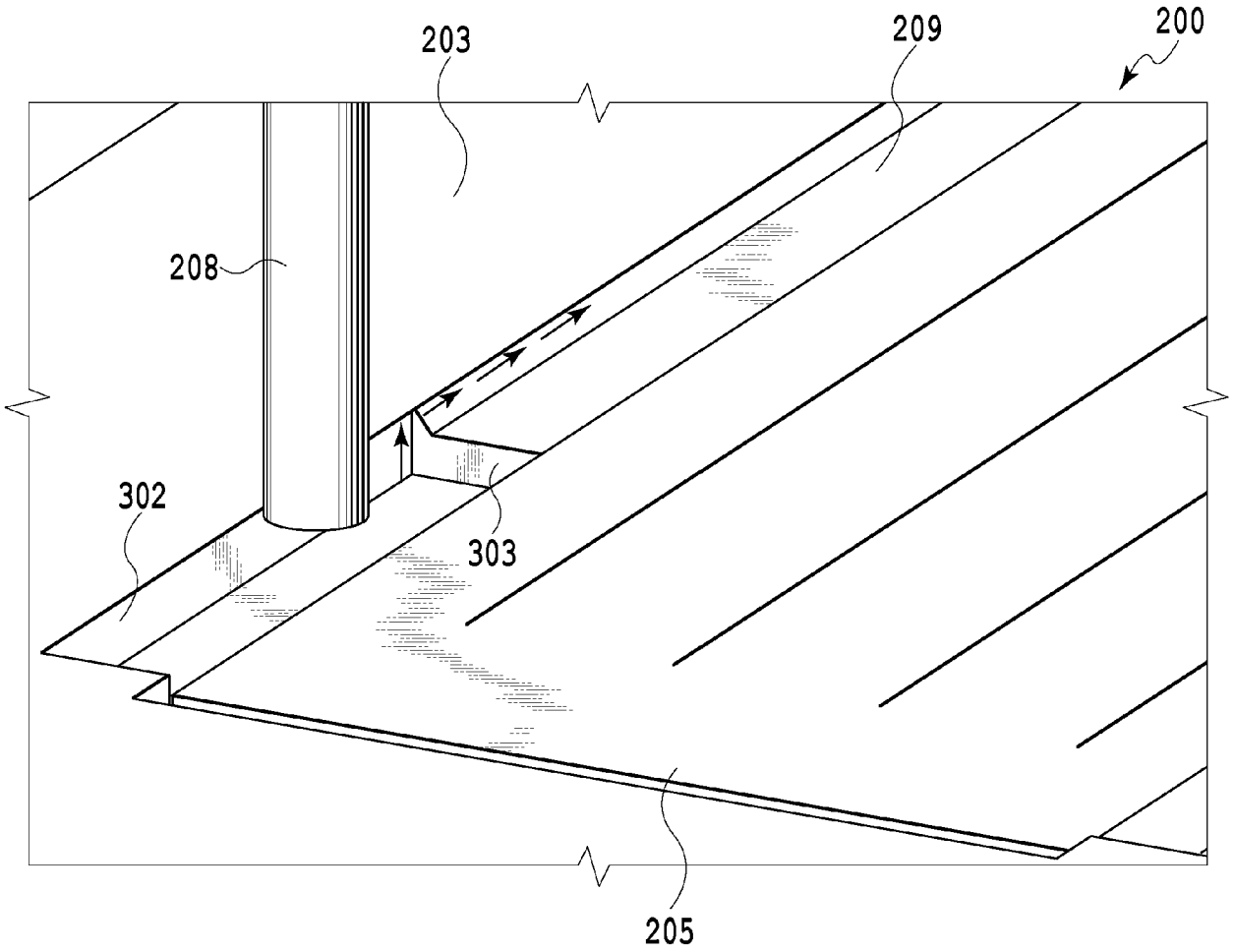
FIG. 7 is a partially enlarged perspective view of the liquid ejection head.

FIG. 6 is a cross-sectional view illustrating a part of a liquid ejection head 200 of the present embodiment and FIG. 7 is a partially enlarged perspective view of the liquid ejection head 200. A second support member 302 of the present embodiment includes a tapered surface 304 provided in the connection portion of a step portion 303. That is, a surface of the second support member 302 connecting the step surface 209 and the substrate mounting surface is formed as a tapered surface.

Since the tapered surface 304 is provided in this way, the sealant 206 can be caused to flow to a boundary surface between the electrical wiring substrate 203 and the second support member 302 by a capillary phenomenon as indicated by the arrow of FIG. 7 even when the sealant having comparatively low viscosity is used. Accordingly, it is possible to insulate and protect the electrical wiring substrate 203 by sealing the boundary surface between the electrical wiring substrate 203 and the second support member 302.

Further, although it is an accompanying effect, the connection portion is thickened due to the tapered surface 304. For this reason, the strength of the second support member 302 can be improved and hence the crack or the damage of the step portion 303 can be suppressed.

Third Embodiment

Hereinafter, a third embodiment of the present invention will be described with reference to the drawings. Furthermore, since the basic configuration of the present embodiment is similar to that of the first embodiment, only a characteristic configuration will be described below.

Figure 8:
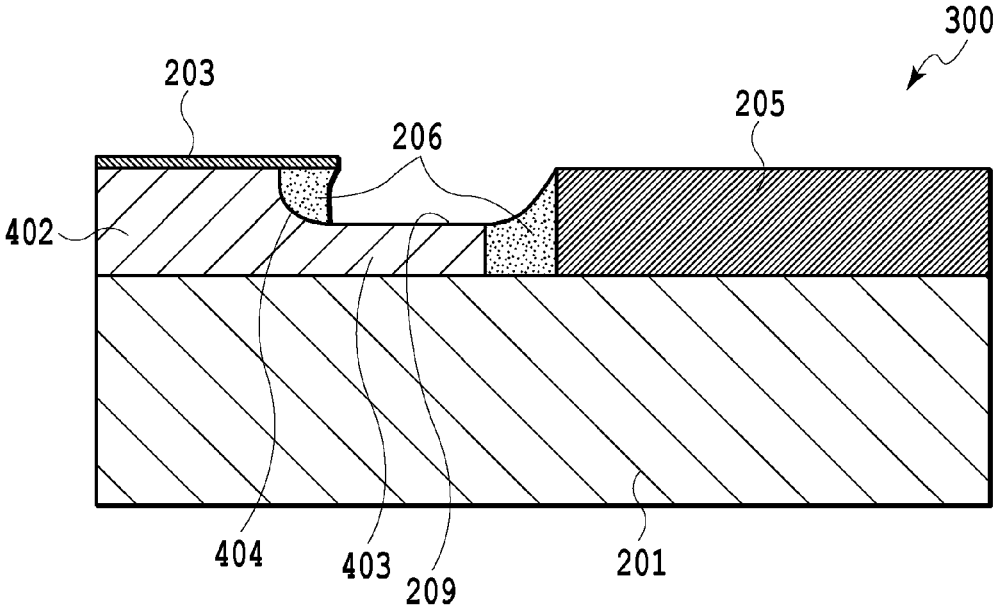
FIG. 8 is a cross-sectional view illustrating a part of the liquid ejection head.
Figure 9:
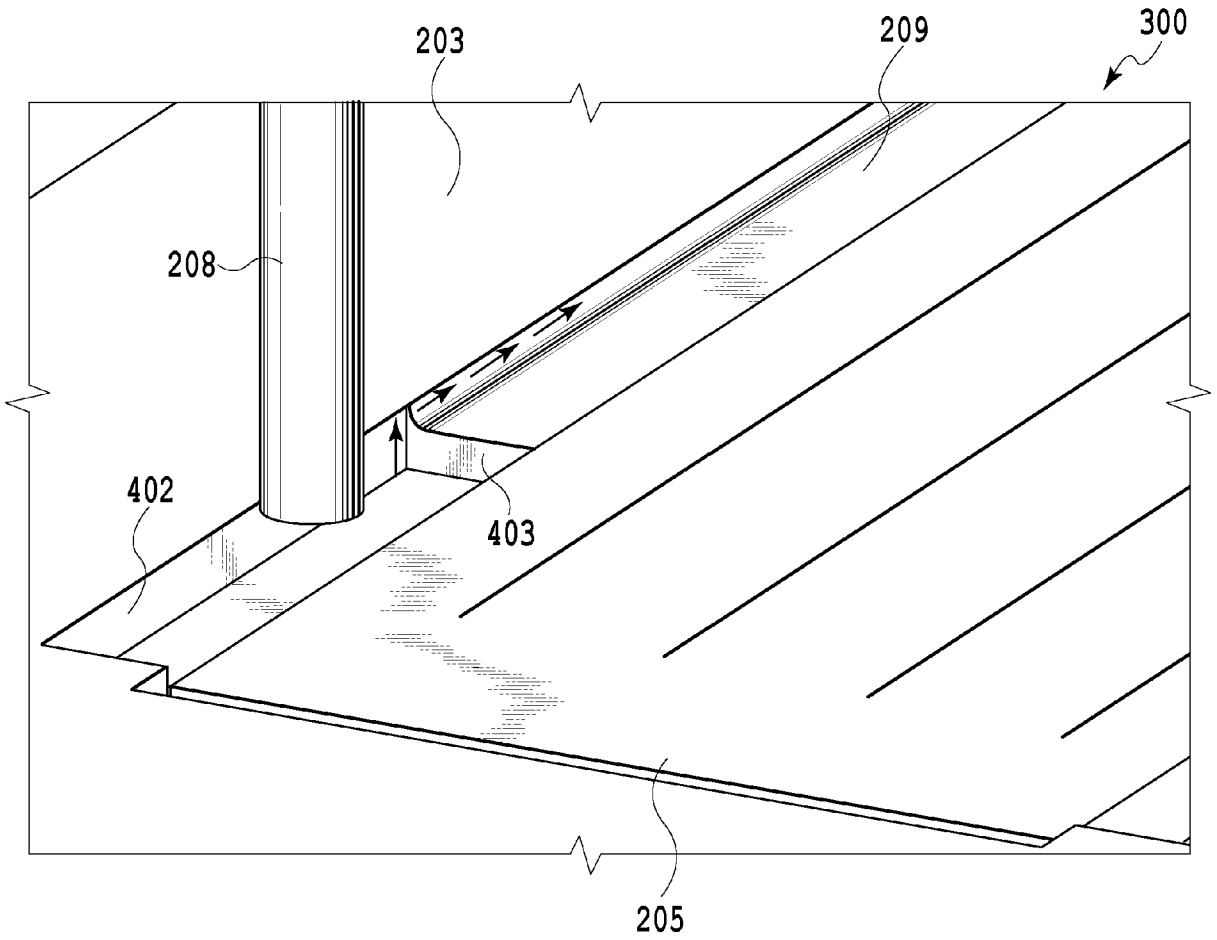
FIG. 9 is a partially enlarged perspective view of the liquid ejection head.

FIG. 8 is a cross-sectional view illustrating a part of a liquid ejection head 300 of the present embodiment and FIG. 9 is a partially enlarged perspective view of the liquid ejection head 300. A surface of a second support member 402 of the present embodiment connecting the step surface 209 of a step portion 403 to the substrate mounting surface is a curved surface 404. Since the curved surface 404 is provided in this way, the sealant 206 can be caused to flow to a boundary surface between the electrical wiring substrate 203 and the second support member 402 by a capillary phenomenon as indicated by the arrow of FIG. 9 even when the sealant having comparatively low viscosity is used. Accordingly, it is possible to insulate and protect the electrical wiring substrate 203 by sealing a boundary surface between the electrical wiring substrate 203 and the second support member 402.

Further, although it is an accompanying effect, the connection portion is thickened due to the curved surface 404. For this reason, the strength of the second support member 402 can be improved and hence the crack or the damage of the step portion 403 can be suppressed.

(Second Support Member Manufacturing Method)

Figure 10A:
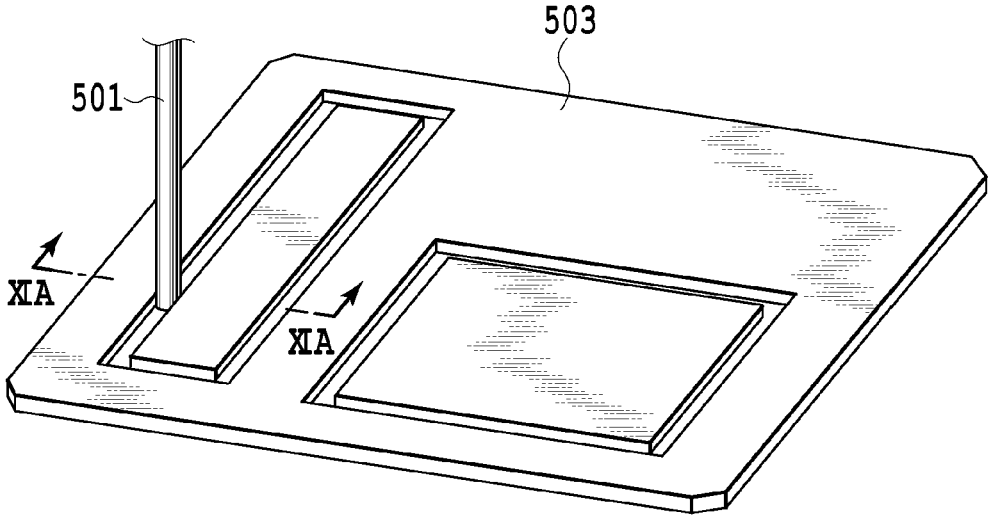
FIG. 10A is a diagram illustrating a part of a second support member manufacturing process.
Figure 10B:
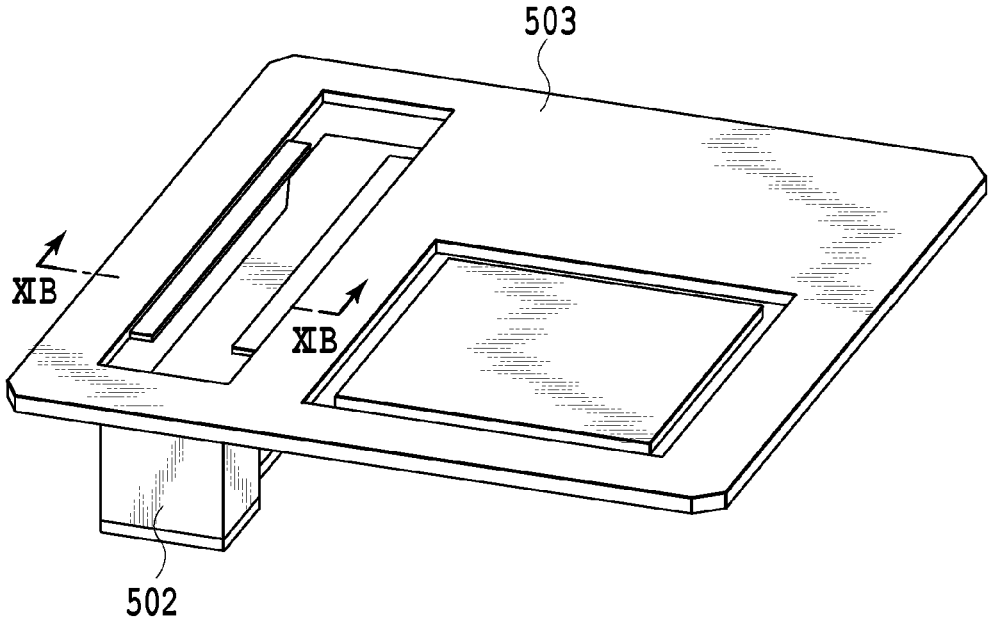
FIG. 10B is a diagram illustrating a part of a second support member manufacturing process.
Figure 11A:
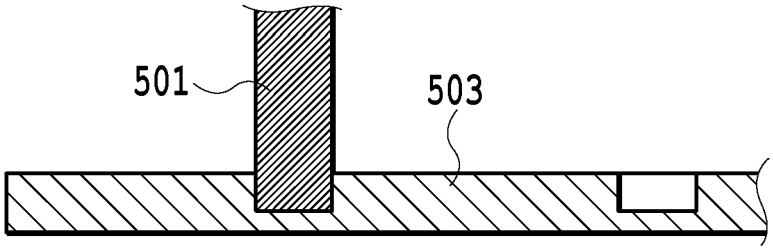
FIG. 11A is a cross-sectional view illustrating the process of FIG. 10A.
Figure 11B:
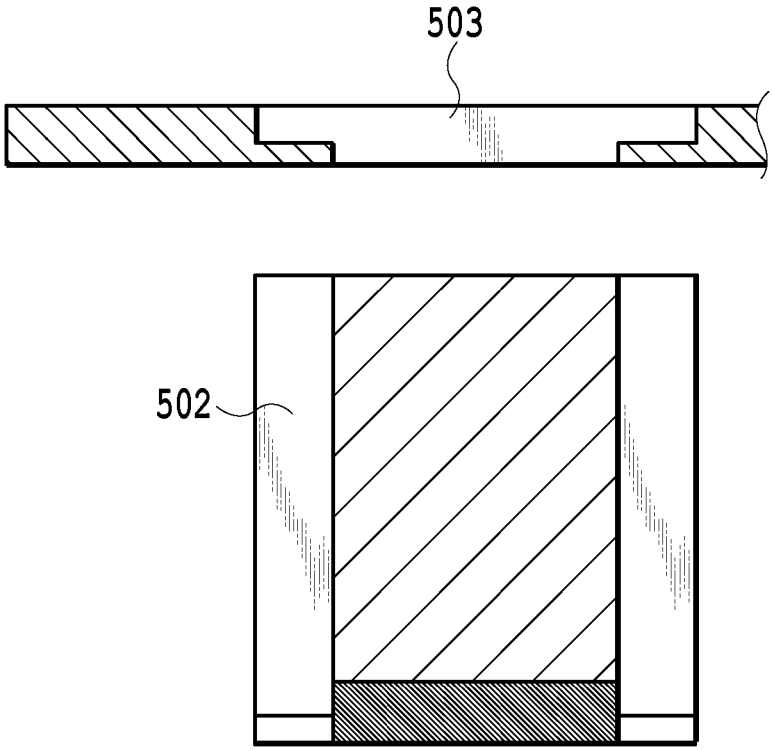
FIG. 11B is a cross-sectional view illustrating the process of FIG. 10B.

FIGS. 10A and 10B are diagrams illustrating a part of a process of manufacturing a second support member 503. Here, FIG. 11A is a cross-sectional view taken along the line XIA-XIA of FIG. 10A and FIG. 11B is a cross-sectional view taken along the line XIB-XIB of FIG. 10B. In the first to third embodiments, the material of the second support member provided with the step portion is not particularly limited. For example, as an example of a case in which a fired article such as a ceramic is used in the second support member, a groove as a step portion is formed in a second support member in a green sheet state by an end mill 501 as in FIG. 10A.

After the groove is formed in the second support member, a predetermined shape is formed in the second support member by a punch 502. Then, a device hole is formed in the second support member and the second support member is baked, thereby forming a step portion in the second support member. Although not illustrated in the drawings, the step portion may be formed by a method of forming a step in a member in advance by a mold and baking the member with the step after injection molding or a method of pressing and baking a powder.

When a cutting process is performed in a green sheet state, the step portion is defined by the shape of a front end of a cutting tool (for example, an end mill). For example, when a ball end mill is used, the step portion can be formed in a curved shape. Then, when a drill nose is used, the step portion can be formed in a tapered shape. For this reason, it is desirable to form the support member (the second support member) by cutting a green sheet.

Regarding the dimension of the step portion in the height direction, it is desirable to set the height (the gap) so that the step portion is lower than the height of the ejection element substrate and a sealant can exhibit a capillary force or a meniscus force in the boundary between the second support member and the electrical wiring substrate. Here, when the step portion is extremely low (or high), there is a possibility that the step portion may be damaged in accordance with the material.

Furthermore, in the above-described embodiments, a configuration has been described in which the second support member and the step portion are integrated with each other. However, the second support member and the step portion may be separated from each other.

Further, in the above-described embodiments, a configuration has been described in which the first support member and the second support member are formed as separate members, but the present invention is not limited thereto. For example, the first support member and the second support member may be integrated with each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-108917, filed May 28, 2015, which is hereby incorporated by reference herein in its entirety.

What is claimed is:

1. A liquid ejection head comprising:

an ejection element substrate that includes an ejection opening surface provided with an ejection opening capable of ejecting a liquid;

an electrical wiring substrate that electrically connects with the ejection element substrate; and a support member that includes a first portion having an electrical wiring substrate mounting surface for mounting the electrical wiring substrate thereon and a second portion having an ejection element substrate mounting surface, different from the electrical wiring substrate mounting surface, for mounting the ejection element substrate thereon, wherein a step portion is formed on a surface of a third portion of the support member along the ejection element substrate, wherein a step surface of the step portion is formed so that a vertical distance from the surface of the third portion of the support member to the step surface is shorter than a vertical distance from the surface of the third portion to the electrical wiring substrate mounting surface and a vertical distance from the surface of the third portion to the ejection opening surface, and wherein a gap between the step portion and the ejection element substrate and a region between a connecting surface connecting the step surface to the electrical wiring substrate mounting surface and the electrical wiring substrate are sealed by a sealant.

2. The liquid ejection head according to claim 1, wherein the step surface includes a part on which no sealant is provided.

3. The liquid ejection head according to claim 1, wherein the sealant that seals the gap and the sealant that seals the region are the same material.

4. The liquid ejection head according to claim 1, wherein the connecting surface connecting the step surface to the electrical wiring substrate mounting surface is a tapered surface.

5. The liquid ejection head according to claim 1, wherein the connecting surface connecting the step surface to the electrical wiring substrate mounting surface is a curved surface.

6. The liquid ejection head according to claim 1, wherein the electrical wiring substrate includes a portion protruding from the electrical wiring substrate mounting surface toward the ejection element substrate, and the region is between the connecting surface connecting the step surface to the electrical wiring substrate mounting surface and the protruding portion of the electrical wiring substrate.

7. The liquid ejection head according to claim 1, wherein the support member includes a first support member that includes the surface of the third portion of the support member so that the ejection element substrate is mounted on a surface that is common to the surface of the third portion, and a second support member that includes the electrical wiring substrate mounting surface having the electrical wiring substrate mounted thereon and the second support member is mounted on the common surface of the first support member.

8. The liquid ejection head according to claim 7, wherein the second support member and the step portion are integral.

9. The liquid ejection head according to claim 7, wherein the second support member is formed so as to surround the periphery of the ejection element substrate.

10. The liquid ejection head according to claim 7, wherein the second support member is formed by cutting a green sheet.

11. A liquid ejection apparatus equipped with a liquid ejection head including an ejection element substrate that includes an ejection opening surface provided with an ejection opening capable of ejecting a liquid, an electrical wiring substrate that electrically connects with the ejection element substrate, and a support member that includes a first portion having an electrical wiring substrate mounting surface for mounting the electrical wiring substrate thereon and a second portion having an ejection element substrate mounting surface, different from the electrical wiring substrate mounting surface, for mounting the ejection element substrate thereon, wherein the liquid ejection head includes a step portion formed on a surface of a third portion of the support member along the ejection element substrate, wherein a step surface of the step portion is formed so that a vertical distance from the surface of the third portion of the support member to the step surface is shorter than a vertical distance from the surface of the third portion to the electrical wiring substrate mounting surface and a vertical distance from the surface of the third portion to the ejection opening surface, and wherein a gap between the step portion and the ejection element substrate and a region between a connecting surface connecting the step surface to the electrical wiring substrate mounting surface and the electrical wiring substrate are sealed by a sealant.

* * * * *